US009520642B2

(12) United States Patent
Blackwelder et al.

(10) Patent No.: US 9,520,642 B2
(45) Date of Patent: Dec. 13, 2016

(54) PNEUMATIC NON-LOCKING LOW-PROFILE TELESCOPING MASTS

(71) Applicants: Paul Bradford Blackwelder, Medina, OH (US); Cameron Jay Young, Parma, OH (US); Clifford Duff, Medina, OH (US)

(72) Inventors: Paul Bradford Blackwelder, Medina, OH (US); Cameron Jay Young, Parma, OH (US); Clifford Duff, Medina, OH (US)

(73) Assignee: The Will-Burt Company, Orrville, OH (US)

( * ) Notice: Subject to any disclaimer, the term of this patent is extended or adjusted under 35 U.S.C. 154(b) by 0 days.

(21) Appl. No.: 15/094,141

(22) Filed: Apr. 8, 2016

(65) Prior Publication Data

US 2016/0301128 A1 Oct. 13, 2016

Related U.S. Application Data

(60) Provisional application No. 62/146,087, filed on Apr. 10, 2015.

(51) Int. Cl.

| | |
|---|---|
| ***E04H 12/34*** | (2006.01) |
| ***H01Q 1/32*** | (2006.01) |
| ***E04H 12/18*** | (2006.01) |
| ***E04H 12/00*** | (2006.01) |
| ***H01Q 1/10*** | (2006.01) |

(52) U.S. Cl.

CPC ..... *H01Q 1/32* (2013.01); *E04H 12/003* (2013.01); *E04H 12/182* (2013.01); *H01Q 1/10* (2013.01)

(58) Field of Classification Search

CPC ..... E04H 12/182; E04H 12/34; E04H 12/085; B60Q 1/2657; H01Q 1/10

USPC ..... 362/385; 52/118

See application file for complete search history.

(56) References Cited

U.S. PATENT DOCUMENTS

| | | | | |
|---|---|---|---|---|
| 2,142,647 A * | 1/1939 | Heller | A24F 19/0071 | 131/241 |
| 4,357,785 A | 11/1982 | Eklund | | |
| 4,513,938 A * | 4/1985 | Seymour | B65F 1/141 | 211/1.3 |
| 4,594,824 A * | 6/1986 | Ziegler | F21V 21/22 | 248/654 |

(Continued)

OTHER PUBLICATIONS

International Search Report dated Jul. 20, 2016.

*Primary Examiner* — Rodney Mintz
*Assistant Examiner* — Daniel Kenny
(74) *Attorney, Agent, or Firm* — Fay Sharpe LLP

(57) ABSTRACT

A telescoping mast assembly having a mast axis and comprising a plurality of telescoping mast sections having axially opposite ends and being axially slidable relative to one another along the mast axis between retracted and extended positions, the telescoping mast sections including a base tube adapted to be fixed to a support surface and an innermost telescoping section, and wherein the innermost telescoping section supports a cylindrical nest lock platform assembly adapted to cover an axial end of the base tube when the mast assembly is in the retracted position, wherein each telescoping mast section includes an internal collar and a cylindrical body and the nest lock platform assembly includes a payload platform and one or more wedges that mate with corresponding notches in the internal collar.

16 Claims, 16 Drawing Sheets

(56) References Cited

U.S. PATENT DOCUMENTS

| | | | | |
|---|---|---|---|---|
| 5,743,635 | A | 4/1998 | Hulse et al. | |
| 5,850,713 | A * | 12/1998 | Hojo | B66F 3/28 212/296 |
| 5,980,070 | A | 11/1999 | Hulse et al. | |
| 6,290,377 | B1 | 9/2001 | Hulse | |
| 6,299,336 | B1 | 10/2001 | Hulse | |
| 6,767,115 | B2 | 7/2004 | Blackwelder | |
| 2006/0201076 | A1 | 9/2006 | Blackwelder | |
| 2014/0311057 | A1 | 10/2014 | Puetz et al. | |

* cited by examiner

PNEUMATIC NON-LOCKING LOW-PROFILE TELESCOPING MASTS

This application claims the benefit of U.S. Provisional Application No. 62/146,087, filed Apr. 10, 2015, incorporated herein by reference in its entirety.

BACKGROUND

The present exemplary embodiment relates to telescoping masts. It finds particular application in conjunction with pneumatically actuated telescoping masts, and will be described with particular reference thereto. However, it is to be appreciated that the present exemplary embodiment is also amenable to other like applications.

Pneumatically actuated telescoping masts are well known in the art, and are, for example, mounted on the roof of a motor vehicle such as an emergency vehicle or utility vehicle. Alternatively, mounting configurations may also involve the floor of a vehicle, allowing the telescoping mast to extend through the roof of the vehicle. The mast is generally used for positioning electrical devices, such as lighting fixtures, at an elevated point above the vehicle. The effect of a lighting fixture is to light a large area around the vehicle, thus allowing emergency procedures to be conducted under the light, such as at accident scenes or by utility work crews during power outages, for example. Pneumatically actuated telescoping masts are particularly advantageous for such uses, because they are lightweight, compact in the retracted position, and quickly transportable to a site by the vehicles on which they are mounted. Pneumatically actuated telescoping masts are extended and retracted using air under pressure and, in a fully extended use position, are usually vertical, although they can be inclined in the use position. The vehicle on which the telescoping mast is mounted typically includes a compressor and appropriate pneumatic controls for displacing the mast sections between retracted and extended positions.

In a typical mast, each telescoping section includes a hollow cylindrical body with a collar secured to an end thereof. The collar can include a keyway (or key) for rotationally interlocking the telescoping section with an adjacent telescoping section or sections. The collar can also provide reinforcement to the cylindrical body.

Many prior art masts utilize a collar at the top of each telescoping section that extends radially outwardly from the cylindrical body. Such collars are often bolted or otherwise secured to the cylindrical body of the telescoping section. This allows an adjacent (smaller diameter) cylindrical body of an adjacent connected telescoping section to be retracted into the larger diameter telescoping section. In this manner, each telescoping section can be retracted into the next larger telescoping section. It will be appreciated, however, that the collars limit the longitudinal extent to which a particular telescoping section can be retracted. That is, the radially-outwardly extending collar of the telescoping section being retracted will ultimately interfere with the collar of the telescoping section into which it is being retracted, thereby limiting further retraction. Accordingly, in a fully retracted state, such masts have a height that is generally determined by a length of the base telescoping section, and the combined height of each collar of each additional telescoping section of the mast.

For example, FIG. 1 shows a prior art pneumatically actuated telescoping mast assembly 10 having a base end mounted within a vehicle 12. More particularly in this respect, mast assembly 10 includes five telescoping mast sections 16, 18, 20, 22, and 24, of which mast section 24 is a base section mounted on floor 14 of vehicle 12. The other four mast sections 22, 20, 18, and 16 extend sequentially along mast axis A from base section 24, and satellite dish 26 is shown atop the uppermost mast section 16 together with a wiring box assembly 17 on which a light is mounted and which encloses the electrical wiring for satellite dish 26. In FIG. 1, mast assembly 10 is shown by solid lines in its fully extended position and, immediately above the vehicle roof, is shown by phantom lines in its fully retracted position. It will be appreciated that each of the telescoping sections includes a radially outwardly extending collar 64 that limits the extent to which each respective telescoping section can be retracted into an adjacent telescoping section.

INCORPORATION BY REFERENCE

Commonly assigned U.S. Pat. Nos. 6,290,377; 5,980,070; 5,743,635; 6,299,336; and 6,767,115 are each incorporated by reference herein so that pneumatically actuated telescoping masts known in the art need not be described in detail hereinafter.

BRIEF DESCRIPTION

While the above-described mast assembly has been commercially successful, recent changes in vehicle designs have produced a need for an improved telescoping mast. For example, in an effort to increase efficiency, vehicles have become more streamlined and, in some cases, smaller, which has altered the available area for mounting a mast. As such, it has become desirable to provide a mast with a lower profile when stowed, but that also achieves the same or similar extended length as a conventional.

In accordance with one aspect of the present exemplary embodiment, a telescoping mast assembly having a mast axis comprises a plurality of telescoping mast sections having axially opposite ends and being axially slidable relative to one another along the mast axis between retracted and extended positions, the telescoping mast sections including a base tube adapted to be fixed to a support surface and an innermost telescoping section, and wherein the innermost telescoping section supports a cylindrical can adapted to surround at least a portion of an axial end of the base tube when the mast assembly is in the retracted position is provided.

In one embodiment, the can includes a cavity defined by a circular top wall and a cylindrical side wall extending from an edge of the top wall, the cavity having an inner diameter sized to closely receive the axial end of the base tube. The base tube includes a projection on a circumferentially outer surface thereof, and the side wall of the can includes an opening adapted to receive the projection when the mast assembly is in the retracted position thereby rotationally interlocking the innermost tube section and the base tube. The protrusion and opening are wedge-shaped. The protrusion is secured to the base tube with a fastener. The protrusion is adjacent an axial end of the base tube. Each telescoping mast section can include an internal collar and a cylindrical body. The internal collar can include an annular body adapted to be inserted into an open end of the cylindrical body, the internal collar having a radially outwardly extending shoulder adapted to engage an axial end face of the cylindrical body. A circumference of the internal collar can correspond to a circumference of the cylindrical body. The internal collar can be secured to the cylindrical body with at least one fastener, such as a machine screw. Each telescoping mast section starting with the innermost telescoping mast section can have a maximum outer diameter that is smaller than the inner diameter of an axial end opening of the telescoping mast section into which it is received.

In accordance with another aspect, a method of rotationally interlocking a plurality of telescoping mast sections of a mast assembly comprises interlocking a can member supported by an innermost telescoping mast section with a base tube of the mast assembly. The interlocking can include telescoping an open end of the can member over an axial end of the base tube when the mast assembly is in a retracted position. The method can include providing a protrusion on a circumferentially outer surface of the base tube, the protrusion adapted to cooperate with an opening of the can member to restrict relative rotation therebetween is provided.

In accordance with yet another aspect, a telescoping mast assembly having a mast axis and comprising a plurality of telescoping mast sections having axially opposite ends and being axially slidable relative to one another along the mast axis between retracted and extended positions, the telescoping mast sections including a base tube adapted to be fixed to a support surface and an innermost telescoping section, and wherein the innermost telescoping section supports a cylindrical nest lock platform assembly adapted to cover an axial end of the base tube when the mast assembly is in the retracted position, wherein each telescoping mast section includes an internal collar and a cylindrical body and the nest lock platform assembly includes a payload platform and one or more wedges that mate with corresponding notches in the internal collar is provided. Optionally, in accordance with any of the previous embodiments, a circumference of the internal collar corresponds to a circumference of the cylindrical body. Additionally, in accordance with any of the previous embodiments, the internal collar may be secured to the cylindrical body with at least one fastener. In accordance with any of the previous embodiments, the at least one fastener may include a machine screw. In accordance with any of the previous embodiments, each telescoping mast section starting with the innermost telescoping mast section may have a maximum outer diameter that is smaller than the inner diameter of an axial end opening of the telescoping mast section into which it is received.

BRIEF DESCRIPTION OF THE DRAWINGS

FIG. 8(*b*) is a perspective view of a half of an exemplary bearing component in accordance with the present disclosure;

FIG. 12(*b*) is a perspective view of the internal collar of FIG. 12(*a*) shown attached to a mast section;

FIG. 12(*c*) is a cutaway side elevation view of the internal collar attached to a mast section;

DETAILED DESCRIPTION

Figure 1:
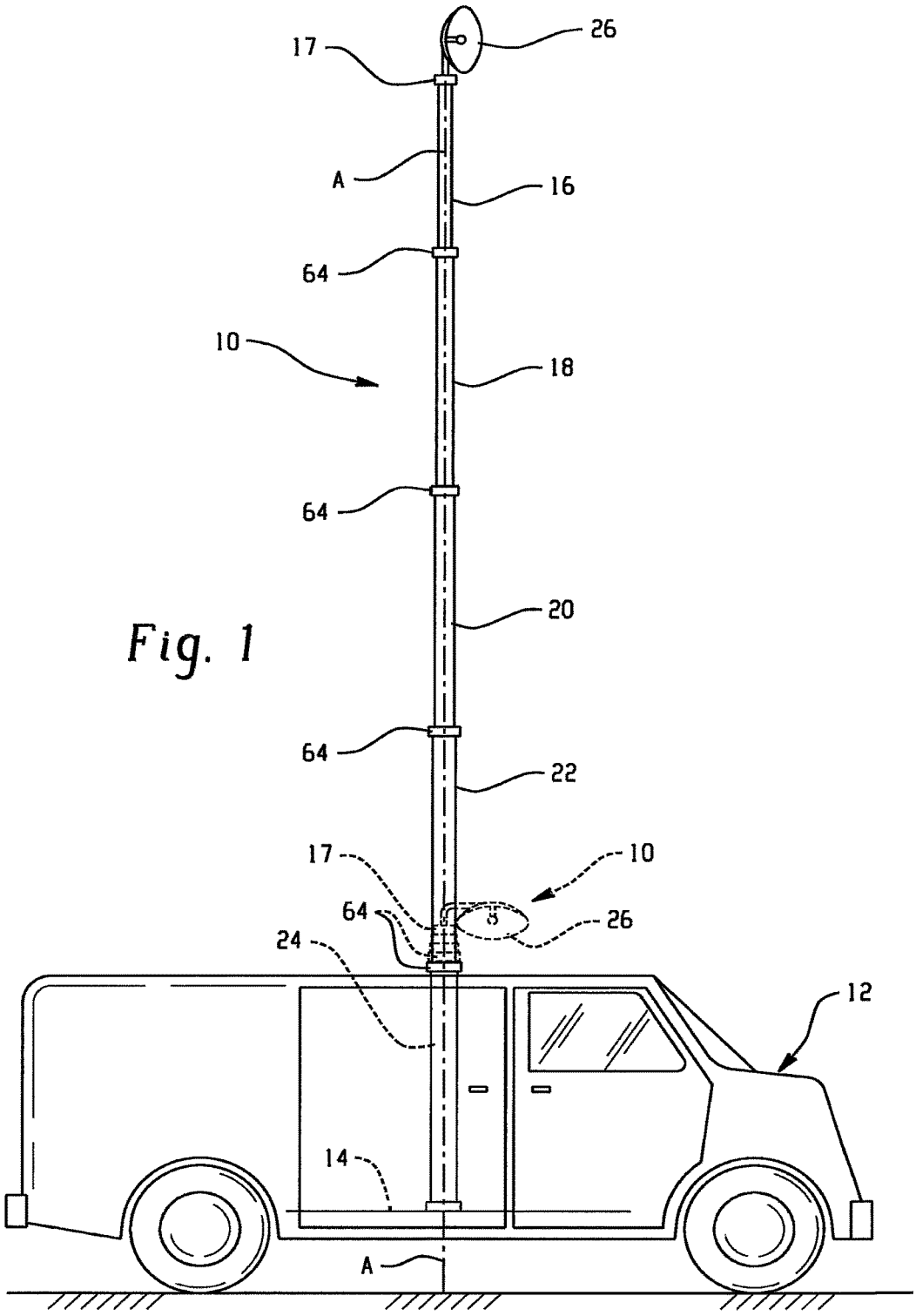
Fig. 1 PRIOR ART
FIG. 1 is a perspective view of a prior art mast assembly mounted on a vehicle.
Figure 2:
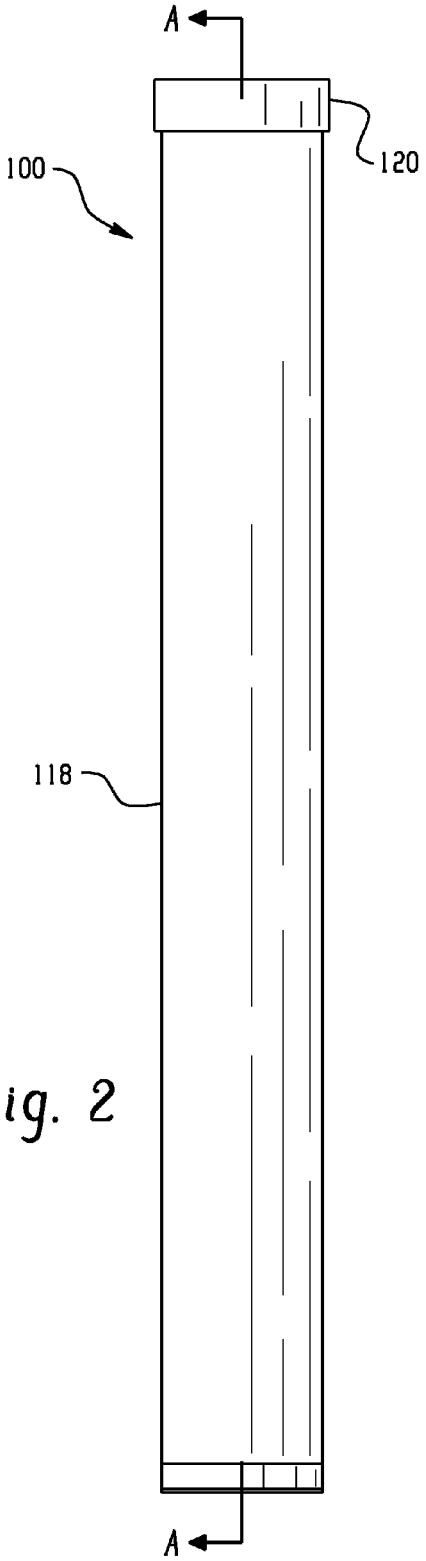
FIG. 2 is a side elevation view of an exemplary mast assembly in accordance with the present disclosure.
Figure 3:
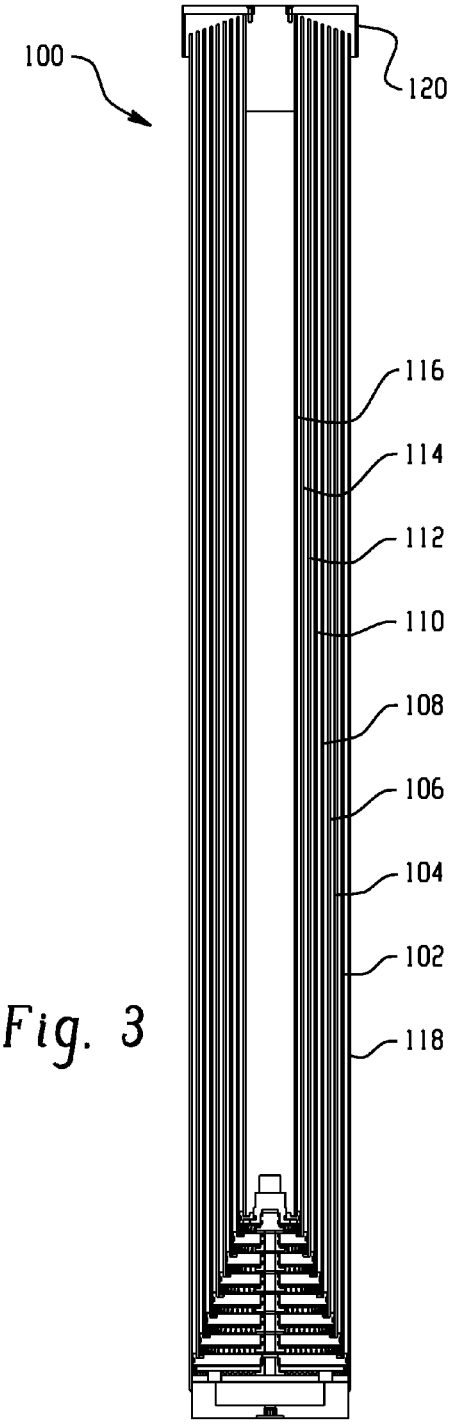
FIG. 3 is a cross-sectional view taken along the line A-A in FIG. 1.
Figure 4:
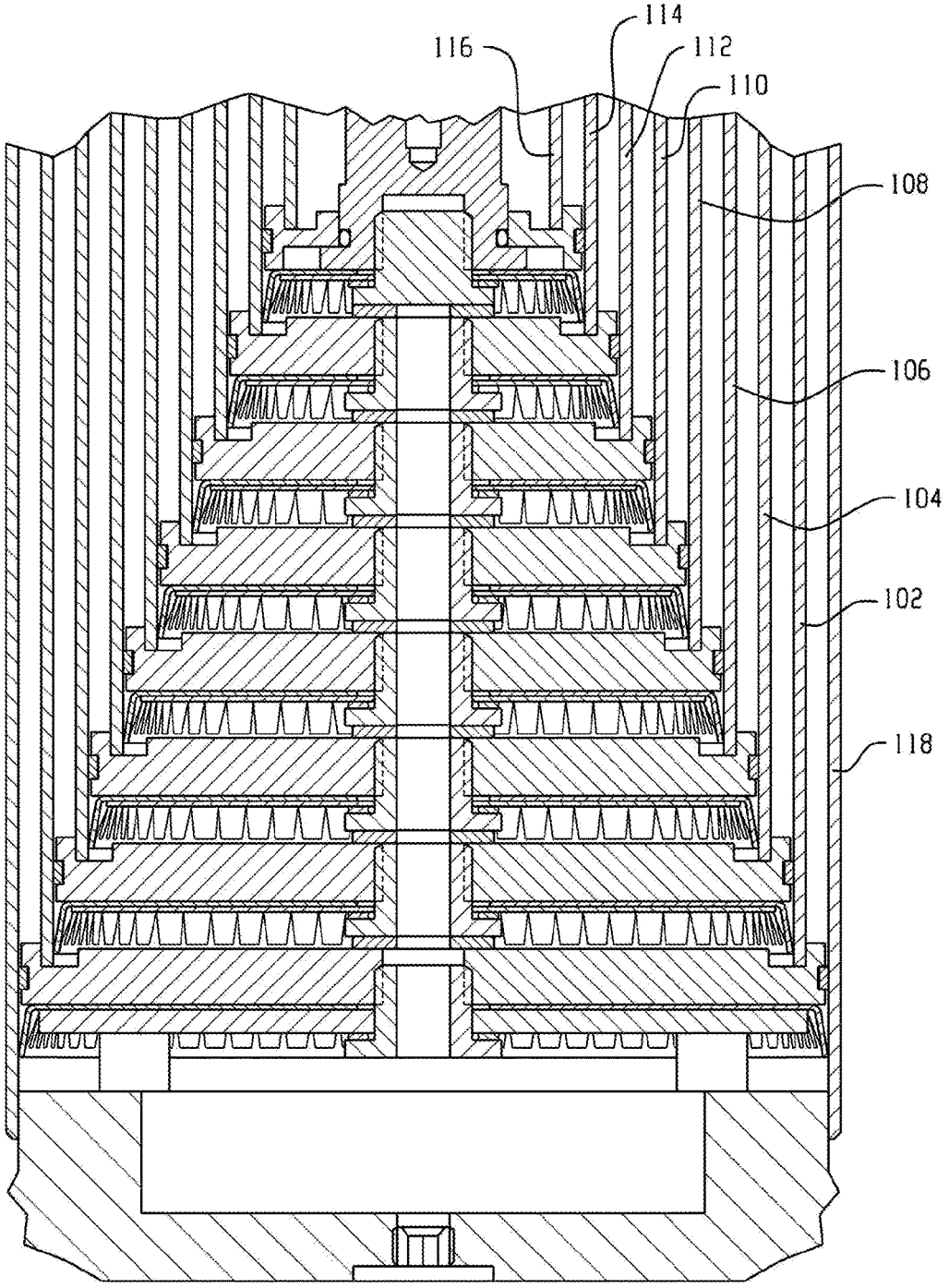
FIG. 4 is an enlarged portion of FIG. 3.

Referring to the remainder of the drawings, wherein the showings are for the purpose of illustrating preferred embodiments of the invention only and are not for the purpose of limiting same, FIG. 2 illustrates an exemplary mast assembly 100 in accordance with the present disclosure. With further reference to FIGS. 3 and 4, the mast assembly 100 generally comprises a plurality of telescoping mast sections 102, 104, 106, 108, 110, 112, 114, 116. As will be appreciated, each of the mast sections 102, 104, 106, 108, 110, 112, 114, 116 is generally telescopically received in an adjacent section and/or base section 118. As the present exemplary embodiment relates to a pneumatically actuated mast, the telescoping mast sections can be sealed together such that pressurized air can be used to extend the telescoping mast sections 102, 104, 106, 108, 110, 112, 114, 116 out of each other and/or the can 120.

Figure 5:
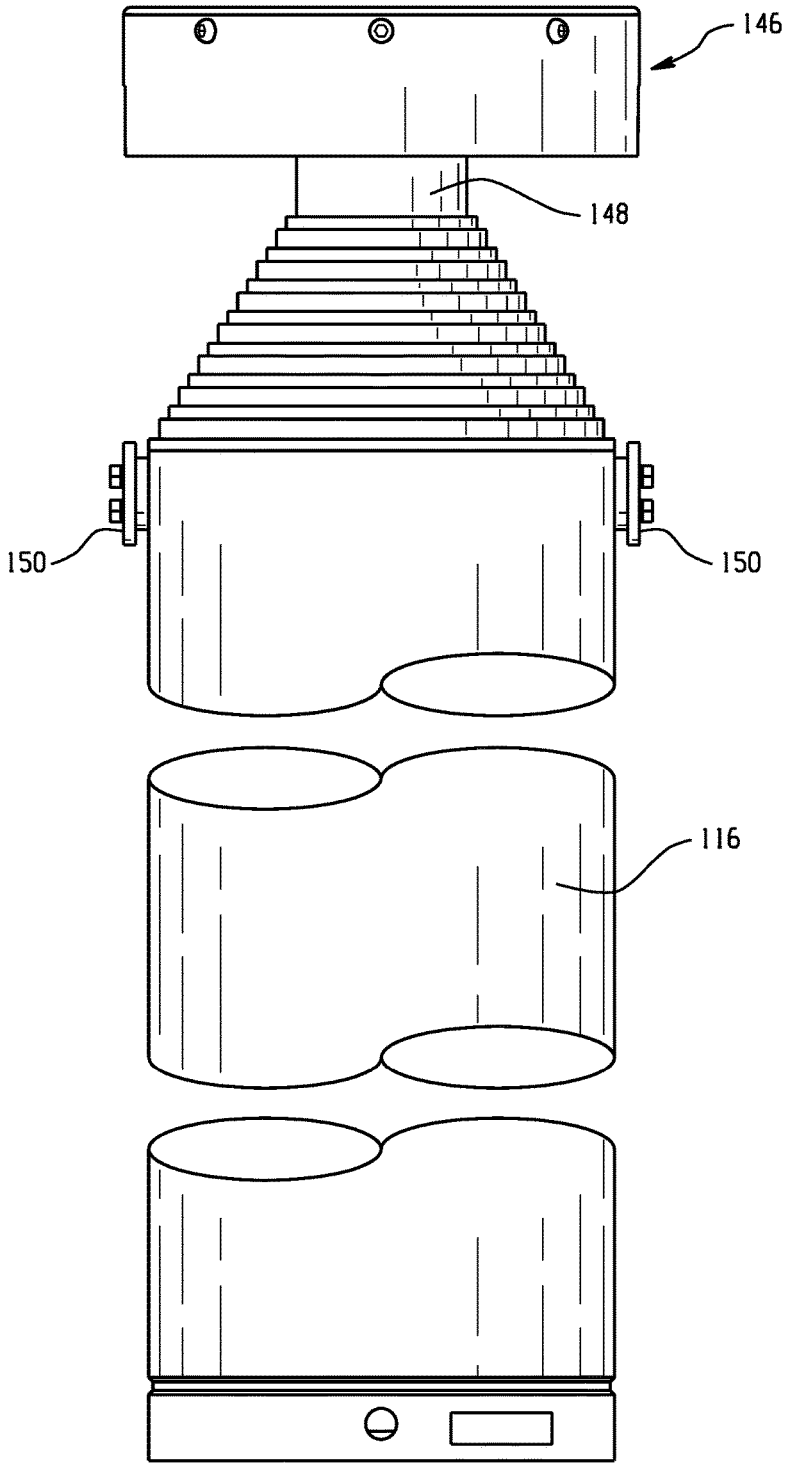
FIG. 5 is a side elevation view of the exemplary mast assembly of FIG. 2 in a partially extended position.
Figure 6:
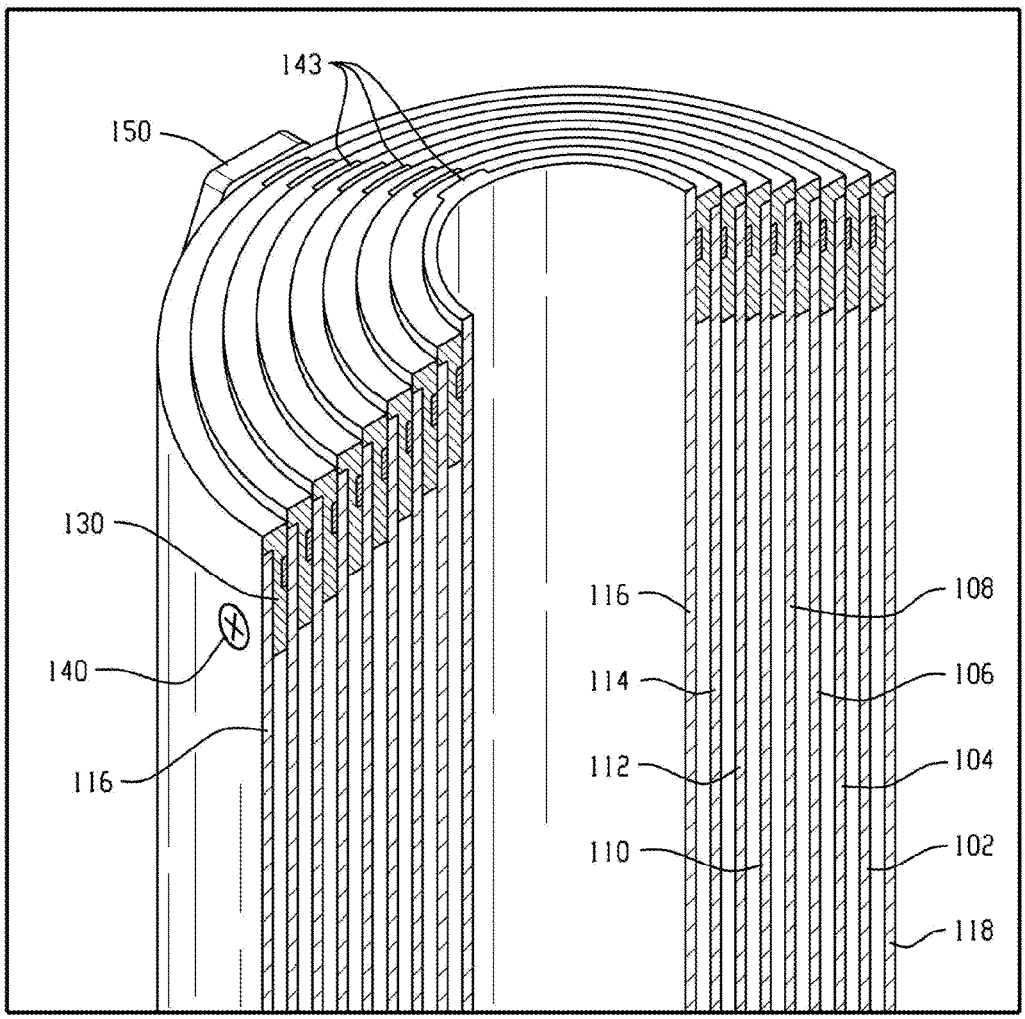
FIG. 6 is a cutaway perspective view of the telescoping mast sections of the exemplary mast assembly.
Figure 7:
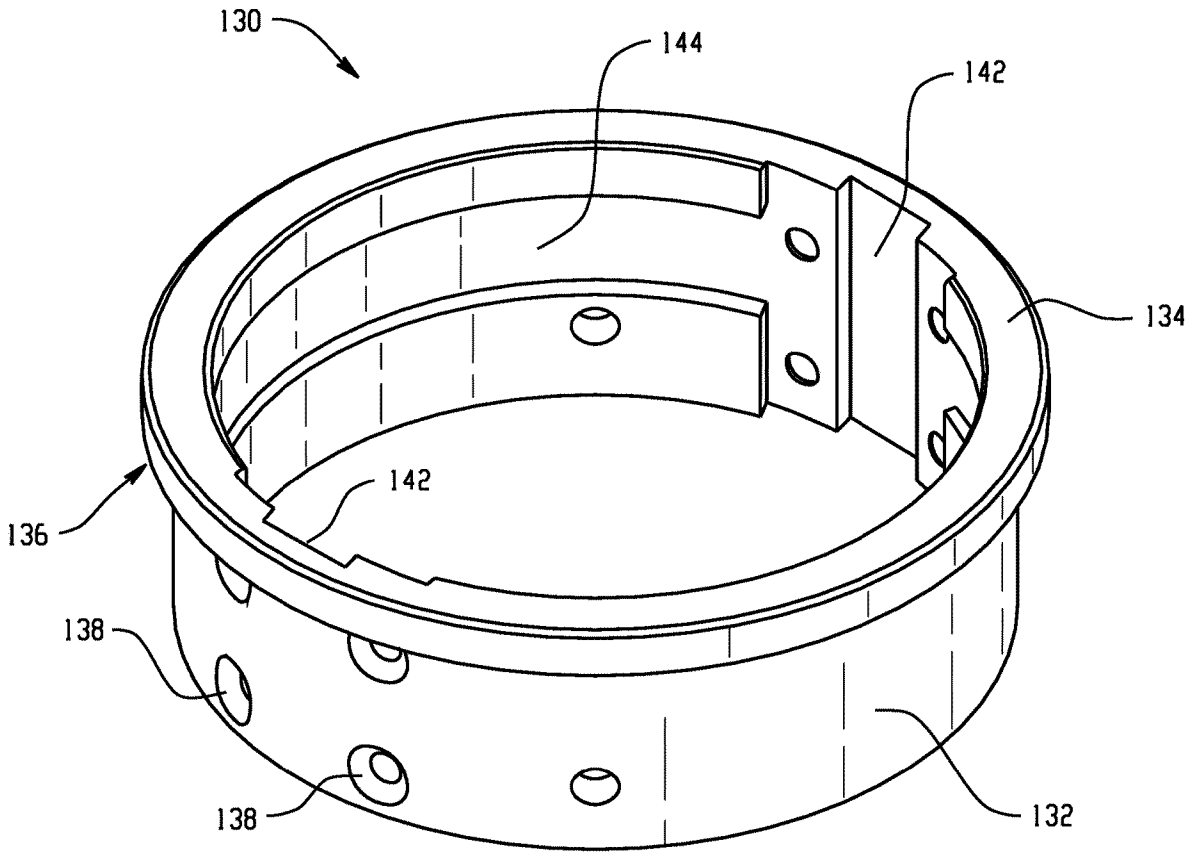
FIG. 7 is a perspective view of an internal collar in accordance with the present disclosure.

With additional reference to FIGS. 5-7, the telescoping mast sections 102, 104, 106, 108, 110, 112, 114, 116 each have associated therewith an internal collar 130 mounted to an upper end thereof. While each internal collar 130 has a diameter corresponding to the diameter of the telescoping mast tube to which it is associated, the features of the internal collars are generally identical. Accordingly, a single internal collar 130 will be described but it should be appreciated that each of the internal collars generally includes the same features.

As shown in FIG. 7, each internal collar 130 generally comprises an annular body 132 adapted to be inserted into an open end of a cylindrical body of a telescoping mast section. The internal collar 130 includes a radially outwardly extending lip 134 having an axial face 136 configured to engage an axial end face of a cylindrical body of the telescoping mast section. A plurality of countersink bores 138 in the circumference of the annular body 132 are provided for receiving suitable fasteners, such as screws 140 (see FIG. 6). The countersink bores (or thru-holes) 138 are generally used for securing the collar bearings. The collars 130 are equipped with fully tapped thru-holes around their circumference. Likewise, the mast sections have thru-holes around their circumference, which align with the tapped thru-holes of their mating collars. The tapped thru-holes receive the screws 140, which then secures the collar to the mast section. Low profile socket head cap screws 140 fasten into the tapped thru-holes of the collar through the thru-holes of the mast section. When fully fastened, the bottom side of the head of the cap screws 140 mate tangent with the outside circumference of the collar. The head of the cap screws 140 are therefore submerged into the thru-holes of the tube section, thus creating a "pin-like" connection. Therefore, the contact point between the cap screw 140 and the tube section is the outside circumference of the head of the cap screw and the circumference of the tube sections thru-hole. The internal collars 130 can be made of any suitable material such as a metal or composite material. The internal collars 130 can be made by any suitable manufacturing process or processes such as molding, casting, machining, etc.

Each internal collar 130 has opposed keyways 142 for receiving keys 143 (see FIGS. 8 and 9) of an adjacent telescoping mast section. The keyways 142 extend axially along a radially inner surface of the annular body 132 between respective pairs of bores 138. A bearing recess 144 extends circumferentially around the inner radial surface of the annular body 132, and the bearing recess 144 is adapted to receive an annular bearing component 145 (not shown in FIG. 7). The annular bearing component 145 can be a low friction material, such as nylon, acetal or polyacetal materials, for example.

Figure 8A:
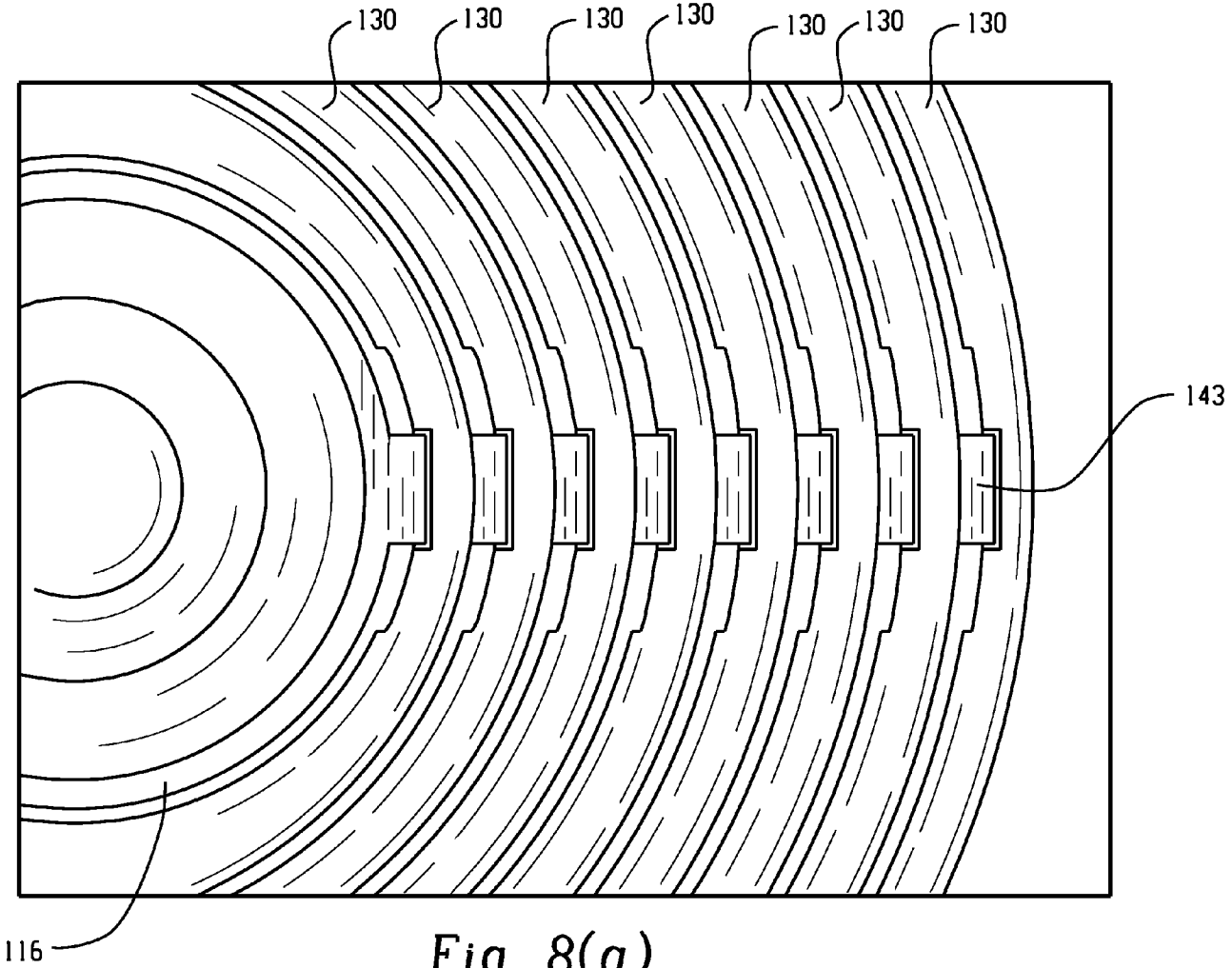
FIG. 8(*a*) is a top view of the exemplary mast assembly in a retracted state.
Figure 8B:
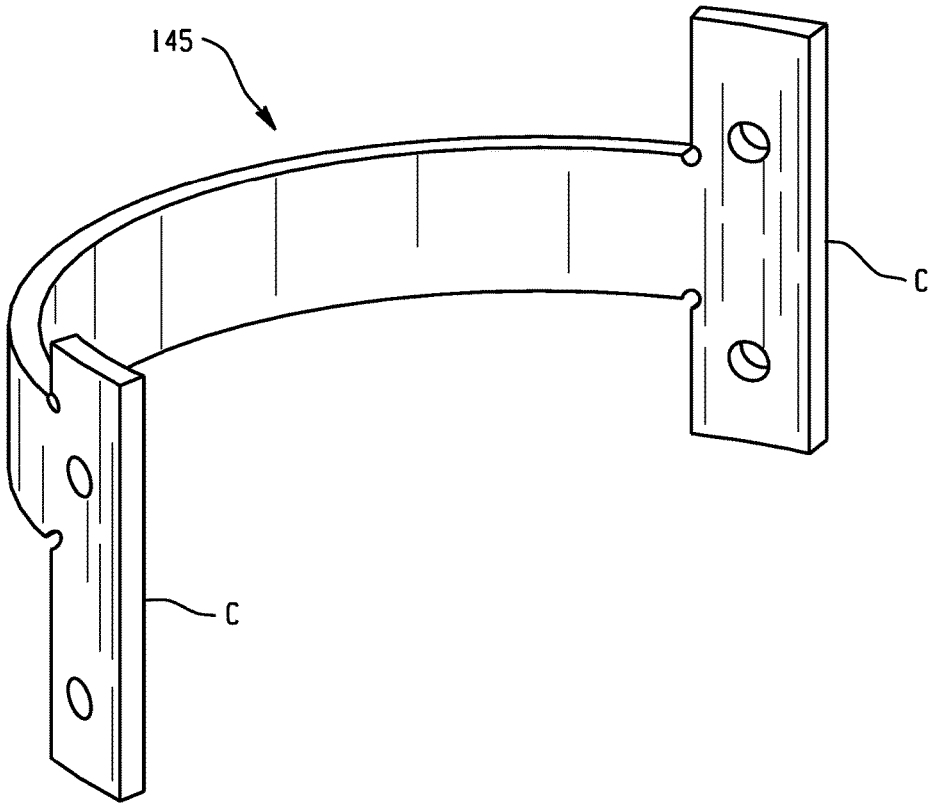

In FIG. 8(*a*), the annular bearing component 145 is illustrated supported in each internal collar 130. As will be appreciated, the bearing component 145 provides a circumferential surface along which an adjacent cylindrical tube section can slide during extension/retraction of the mast assembly 100.

With further reference to FIG. 8(*b*), a portion of bearing component 145 is shown in isolation. It will be appreciated that the bearing component 145 extends about a major portion of the inner circumference internal collar 130 to provide bearing support for the outside diameter of an adjacent tube section. In addition, the bearing component 145 also provides bearing support against the key of the adjacent tube section. In this regard, it will be appreciated that the circumferential end faces C of each of the bearing component halves terminate adjacent the keyway 142. Thus, in the illustrated embodiment, the circumferential edges C of each half of the bearing component 145 define a portion of the keyway 142.

Returning to FIG. 5, the mast assembly 100 includes a cylindrical payload support 146 (also referred to herein as a can) supported by a stub 148 securing to the innermost telescoping mast section 116. The can 146 is configured to nest over the top of the retracted telescoping mast sections 102, 104, 106, 108, 110, 112, 114, 116 and the surround an upper portion of base section 118 when the mast assembly 100 is fully retracted. The can 146 is configured to rotationally interlock with the base tube 118 when the mast assembly 100 is fully retracted, thereby restricting relative rotation between the telescoping mast sections 102, 104, 106, 108, 110, 112, 114, 116.

Figure 10:
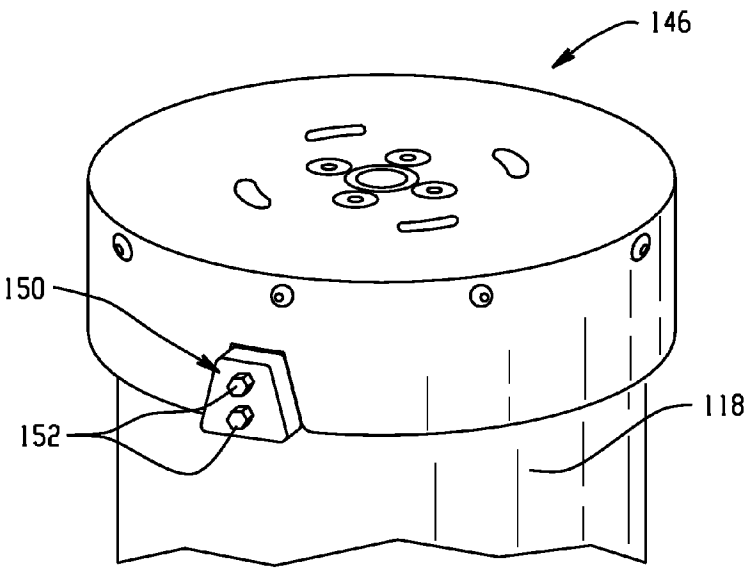
FIG. 10 is a perspective view of the exemplary mast assembly in a retracted state.
Figure 9:
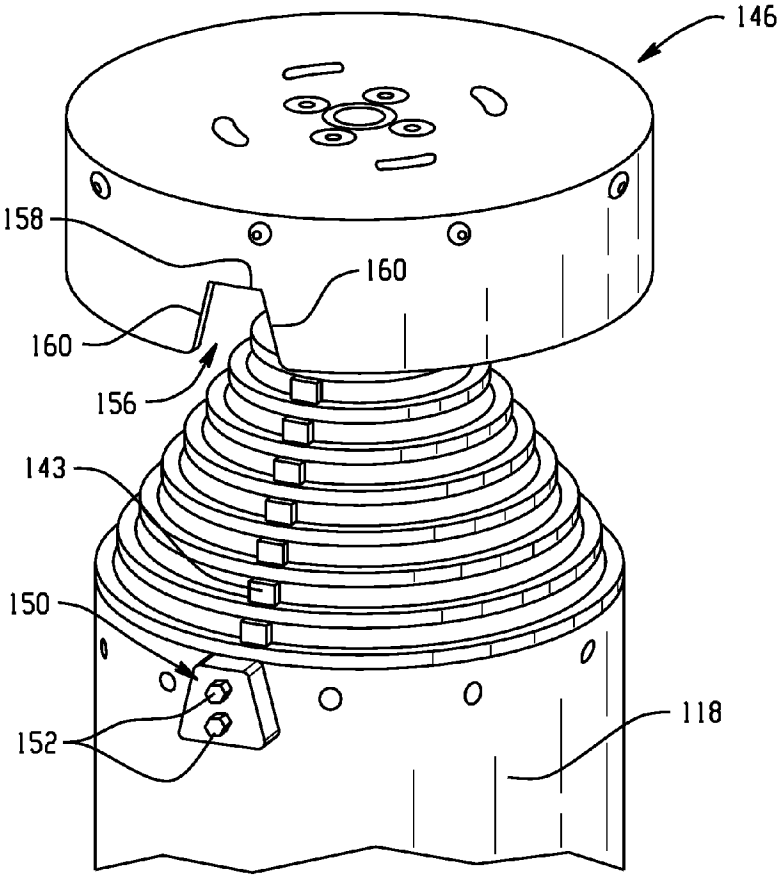
FIG. 9 is a perspective view of the exemplary mast assembly in a partially extended state.

Turning to FIGS. 9 and 10, a nest lock member 150 is mounted to the radially outer circumference of the base tube 118 with a pair of fasteners 152. In other embodiments, the nest lock member 150 can be secured to the base tube 118 with other types of fasteners, or can be formed integrally with the base tube 118. The nest lock member 150 is generally wedge-shaped having a narrow end facing the can 120, which in turn has a corresponding wedge-shaped opening or slot 156. The slot 156 includes a base wall 158 extending between side walls 160. Thus, the can 146, the nest lock member 150, the fasteners 152, the slot 156, the base wall 158, and the side walls 160 generally define a can-style nest lock system.

It will be appreciated that, when the mast assembly 100 is fully retracted, the side walls 160 of the slot 156 engage opposed sides of the nest lock member 150 thereby restricting rotation of the can 146. Because the can is fixed to the innermost tube and all of the tubes are keyed together, each of the tube sections is locked against relative rotation therebetween. The base wall 158 of the slot 156 can abut the top of the nest lock member 150 and, in some embodiments, act as a stop for restricting further retraction of the mast assembly 100.

In some embodiments, the nest lock member 150 and the slot 156 can have other shapes. In addition, while the illustrated embodiment includes two nest lock members 150 spaced approximately opposite each other (see FIG. 5), a single nest lock member or more than two nest lock members can be used. In another embodiment, the nest lock member 150 can be adjustably secured to the base tube such that its axial position relative to the axial end of the base tube can be adjusted. For example, the nest lock member 150 can be adjusted so that the can 146 engages the nest lock member 150 before or after the mast assembly 100 is fully retracted. To this end, the nest lock member 150 can be provided with slots through which one or more fasteners 152 pass. The slots can allow for adjustment of the axial position of the nest lock member as desired.

It should now be appreciated that the internal collars 130 facilitate a low profile nested configuration such that the can 146 has a relatively short axial extent while still covering all of the telescoping mast sections and partially surrounding the base tube 118. By minimizing the axial extent of the can 146, the weight of the can 146 is minimized, thereby maximizing the mast payload. In one embodiment, a mast with a 50-foot extended height includes a can 146 with an axial length of less than 3 inches (e.g., 2.875 inches).

In addition to rotationally interlocking the telescoping mast sections, the can 146 also provides protection from the elements and reduces ingress of moisture and/or contaminants when the mast assembly 100 is in a stowed (retracted) configuration. Accordingly, a suitable sealing element or gasket can be provided for sealing between the can 146 and the base tube (not shown). The can 146 also provides an enlarged surface for securing a payload, such as lighting fixtures and other types of electrical devices.

An alternative embodiment of the nest lock system, i.e., a platform and collar nest lock system 200, for use with the mast sections 102, 104, 106, 108, 110, 112, 114, 116 and the base section 118 is shown in FIGS. 11-20 and discussed below. One of the platform and collar nest lock system's functions is to eliminate rotational slop between mast tube sets about the central axis of the mast.

Figure 11:
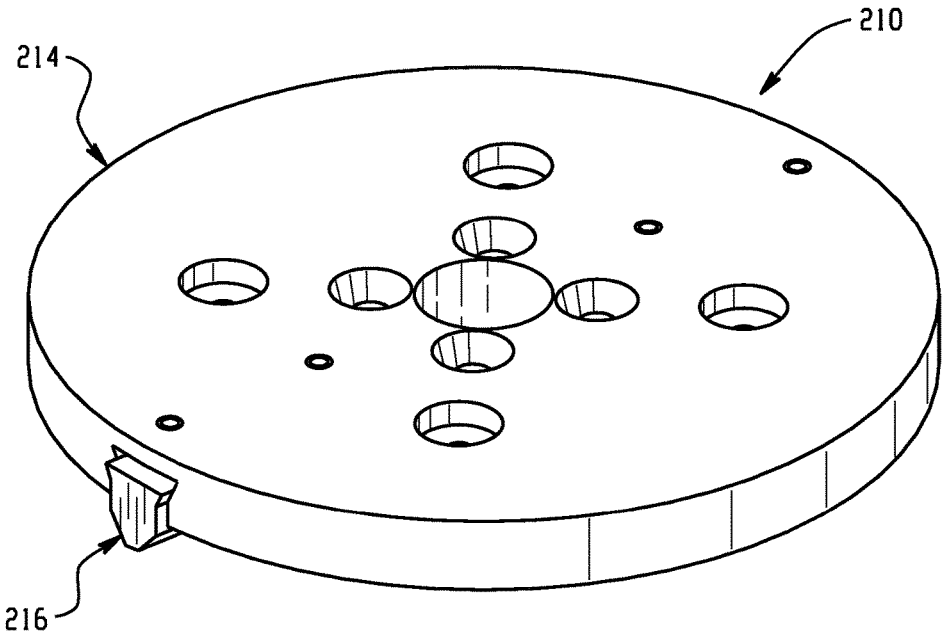
FIG. 11 is a perspective view of a nest lock platform assembly in accordance with the present disclosure.
Figure 12A:
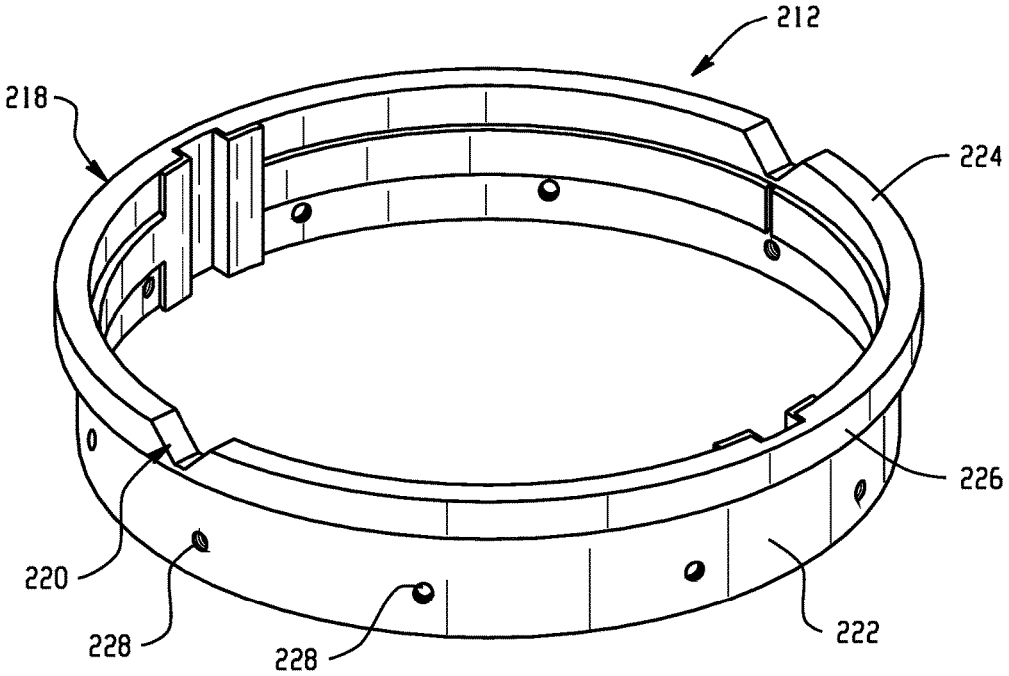
FIG. 12(*a*) is a perspective view of an alternative embodiment of the internal collar in accordance with the present disclosure.
Figure 12B:
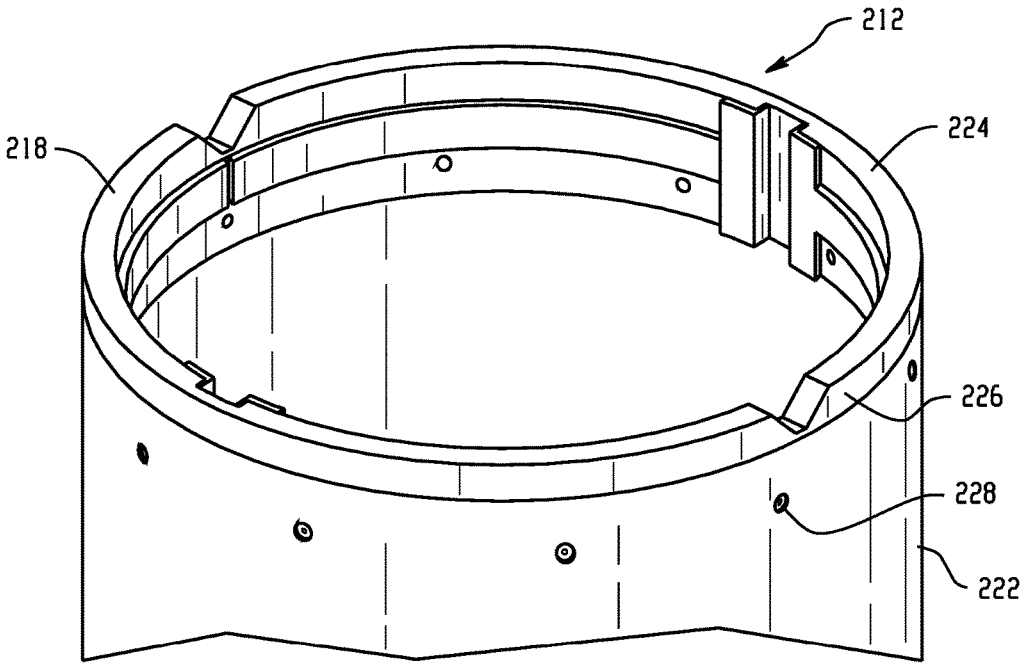
Figure 12C:
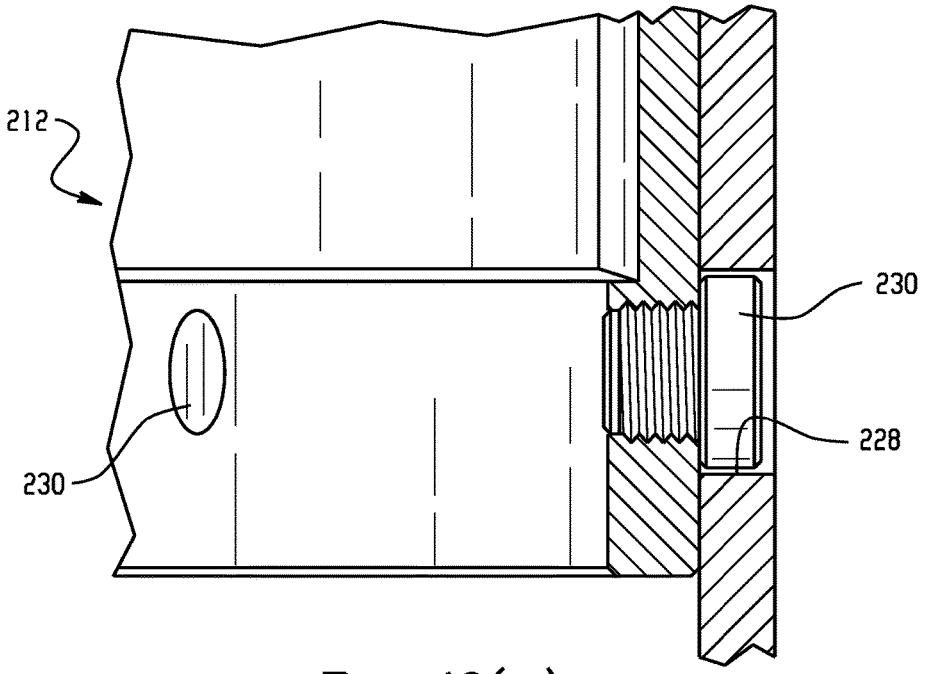

With reference to FIGS. 11 and 12, the two main components that make up the platform and collar nest lock system 200 are a nest nock platform assembly 210 and an internal collar 212. The nest lock platform assembly 210 includes a payload platform 214 and wedges 216. The internal collar 212 includes a pair of notches 220.

When the nest lock platform assembly 210 engages the internal collar 212, the wedges 216 of the nest lock platform assembly mate with the notches 220 of the internal collar. This mating process helps to eliminate rotational slop between the top tube (not shown) and its mating tube (not shown). The nest lock platform assembly 210 mounts to the top tube stub, which mounts to the top tube. The nest lock platform assembly 210 mounts to the mast in generally the same way as the can-style nest lock system as described above.

With additional reference to FIG. 12, a plurality of telescoping mast sections (e.g., the telescoping mast sections 102, 104, 106, 108, 110, 112, 114, 116 of FIGS. 5 and 6) may alternatively have associated therewith the internal collar 212 mounted to an upper end thereof. While each internal collar 212 has a diameter corresponding to the diameter of the telescoping mast tube to which it is associated, the features of the internal collars are generally identical. Accordingly, a single internal collar 212 will be described but it should be appreciated that each of the internal collars generally includes the same features.

As shown in FIGS. 12(*a*)-(*c*), each internal collar 212 generally comprises an annular body 222 adapted to be inserted into an open end of a cylindrical body of a telescoping mast section. The internal collar 212 includes a lip 224 having an axial face 226 configured to engage an axial end face of a cylindrical body of the telescoping mast section. A plurality of countersink bores 228 in the circumference of the annular body 222 are provided for receiving suitable fasteners, such as screws 230. As above, the countersink bores (or thru-holes) 228 are generally used for securing the collar bearings. The collars 212 are thus equipped with fully tapped thru-holes around their circumference. Likewise, the mast sections have thru-holes around their circumference, which align with the tapped thru-holes of their mating collars. The tapped thru-holes receive the screws 230, which then secures the collar to the mast section. Low profile socket head cap screws 230 fasten into the tapped thru-holes of the collar through the thru-holes of the mast section. When fully fastened, the bottom side of the head of the cap screws 230 mate tangent with the outside circumference of the collar. The head of the cap screws 230 are therefore submerged into the thru-holes of the tube section, thus creating a "pin-like" connection. Therefore, the contact point between the cap screw 230 and the tube section is the outside circumference of the head of the cap screw and the circumference of the tube sections thru-hole. The internal collars 212 can be made of any suitable material such as a metal or composite material. The internal collars 212 can be made by any suitable manufacturing process or processes such as molding, casting, machining, etc. Each internal collar 212 has opposed notches 220 for receiving the wedges 216 of the platform assembly 210 (see FIG. 18) of an adjacent telescoping mast section.

Figure 13:
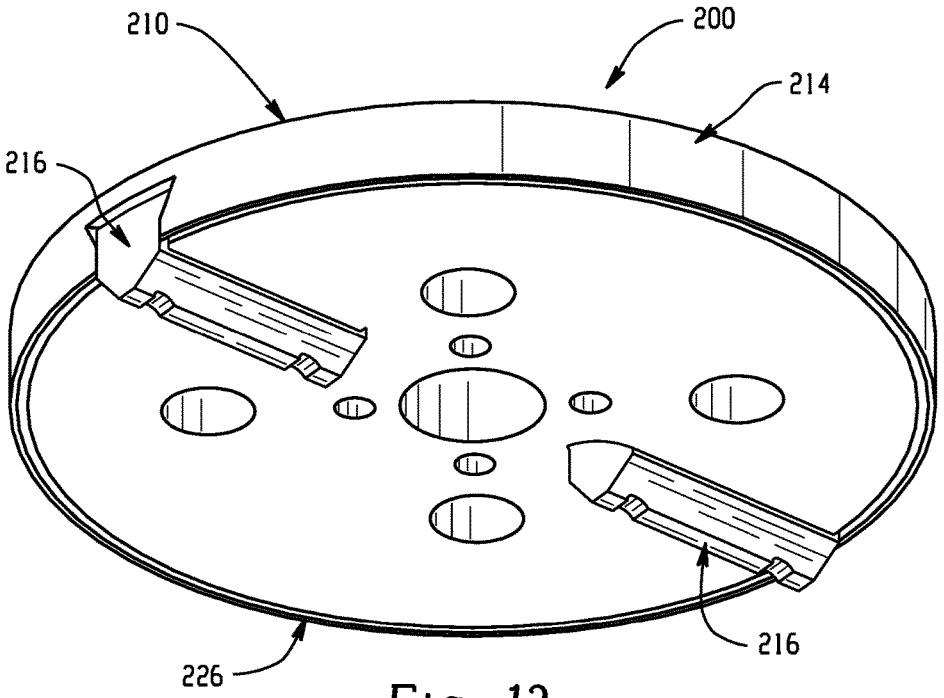
FIG. 13 is a perspective view of the alternative nest lock system.
Figure 14:
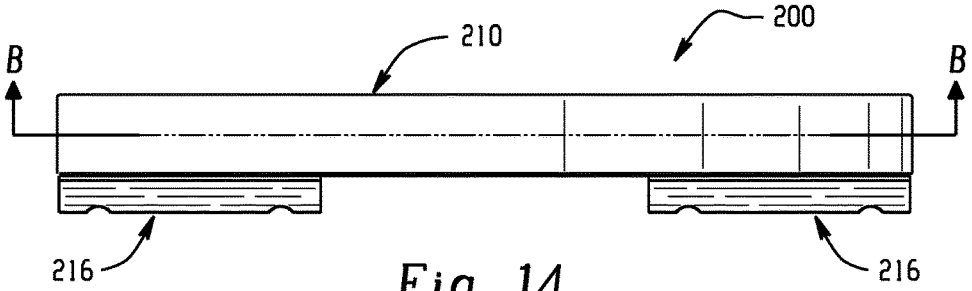
FIG. 14 is a side elevation view of the nest lock system of FIG. 13.
Figure 15:
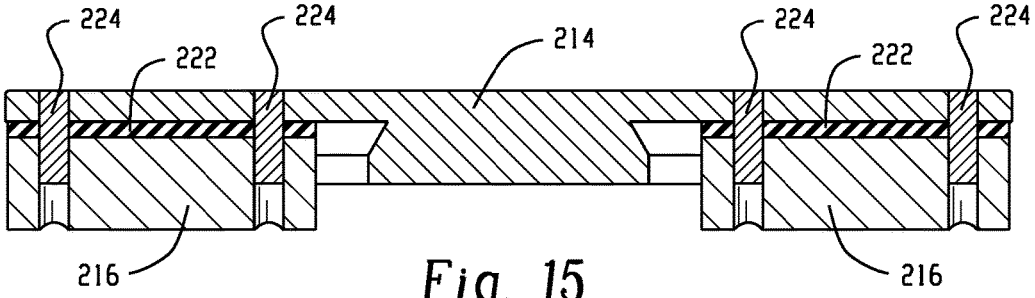
FIG. 15 is a cross-sectional view taken along the line B-B in FIG. 14.
Figure 17:
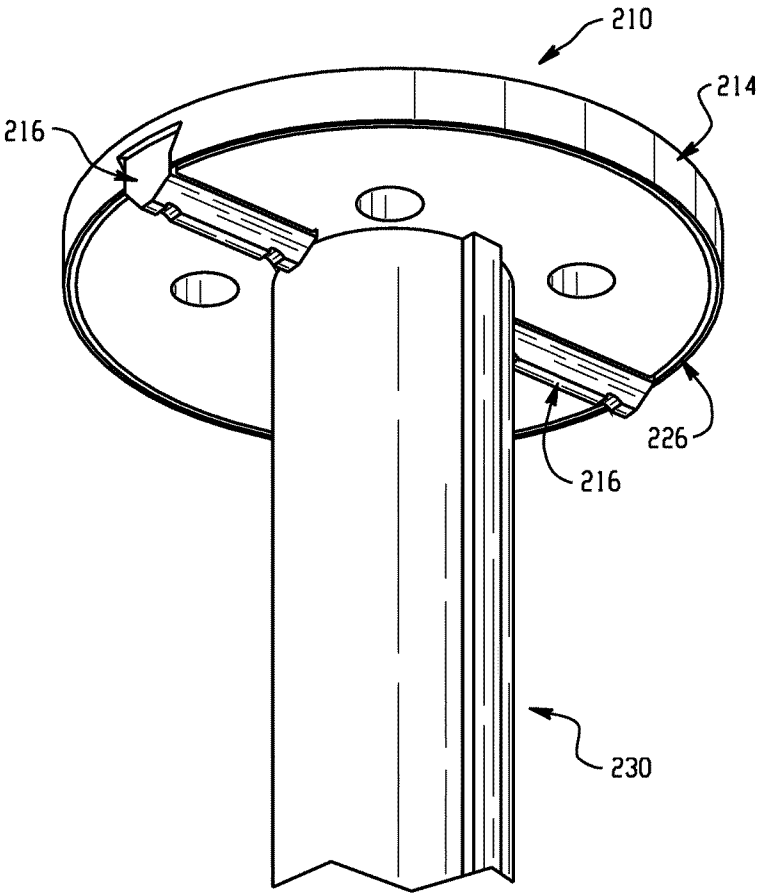
FIG. 17 is a perspective view of the alternative nest lock system on a mast.
Figure 16:
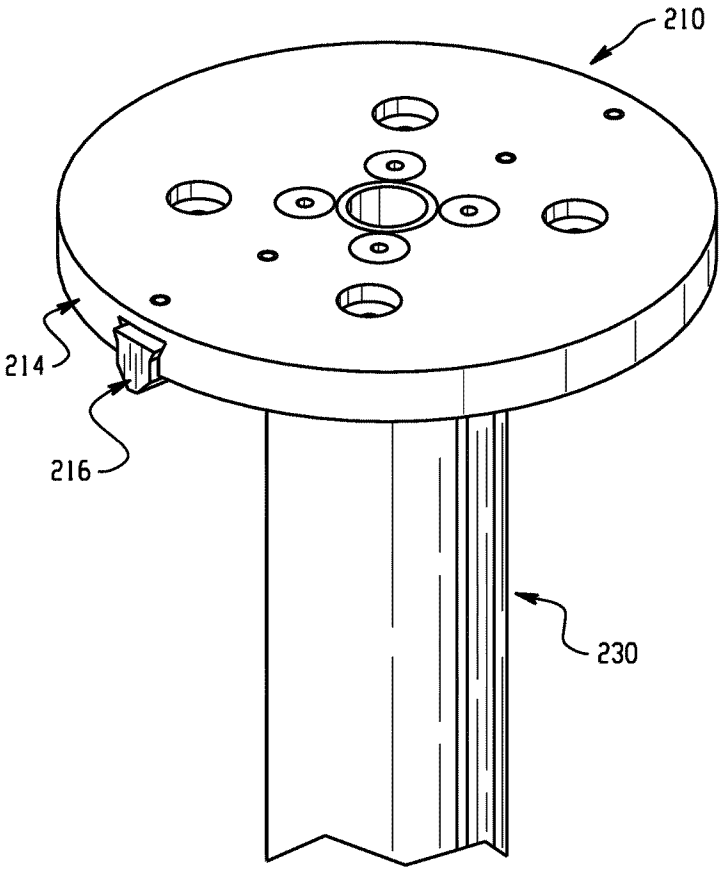
FIG. 16 is a perspective view of the alternative nest lock system on a mast.

The platform and collar nest lock system 200, including the nest lock platform assembly 210, the payload platform 214, and the wedges 216, is shown in greater detail in FIGS. 13-15. As shown in FIG. 15, the nest lock platform assembly 210 includes the payload platform 214, the wedges 216, a pair of rubber bumpers 222, four roll pins 224, and an O-ring cord 226.

The O-ring cord 226 is adhered into a groove around the bottom side of the payload platform 214. The O-ring cord 226 seals off the mast and thus prevents debris and water from getting inside when the mast is completely nested. Optionally, in accordance with any of the previous embodiments, the O-ring cord 226 could be replaced by a rubber pad, which would cover the entire bottom face of the nest lock platform assembly 210. The wedges 216 are held in place by the pins 224 and a dovetail feature on the sides of the payload platform 214. The roll pins 224 are press-fit into the payload platform 214 and float freely inside of the wedges 216 through holes (not shown). This allows the wedges 216 to move freely along the axial direction of the roll pins 224 (i.e., up and down). The rubber bumpers 222 are located between the dovetail ceilings of the payload platform 214 and the top of the wedges 216. It is to be understood that the rubber bumpers 222 could be rubber pads, springs, Belleville washers, or anything of that nature. The rubber bumpers 222 generally function as springs and compress when the wedges 216 engage the notches 220 of the internal collars 218. This allows the wedges 216 to be "self-adjusting." In some embodiments, the wedges 216 and the notches 220 can have other shapes. In addition, while the illustrated embodiment includes two wedges 216 spaced approximately opposite each other (see FIG. 13), a single wedge or more than two wedges can be used. A dovetail is cut into two opposite sides of the nest lock platform assembly 210. Each of the wedges 216 has similar dovetail geometry. When the wedge 216 is placed into the dovetail cut out of the nest lock platform assembly 210 it is constrained in such a manner that it cannot fall out in a "downward" direction. It can, however, still move upwards when force is applied compressing the rubber pad, spring, etc.

Figure 19:
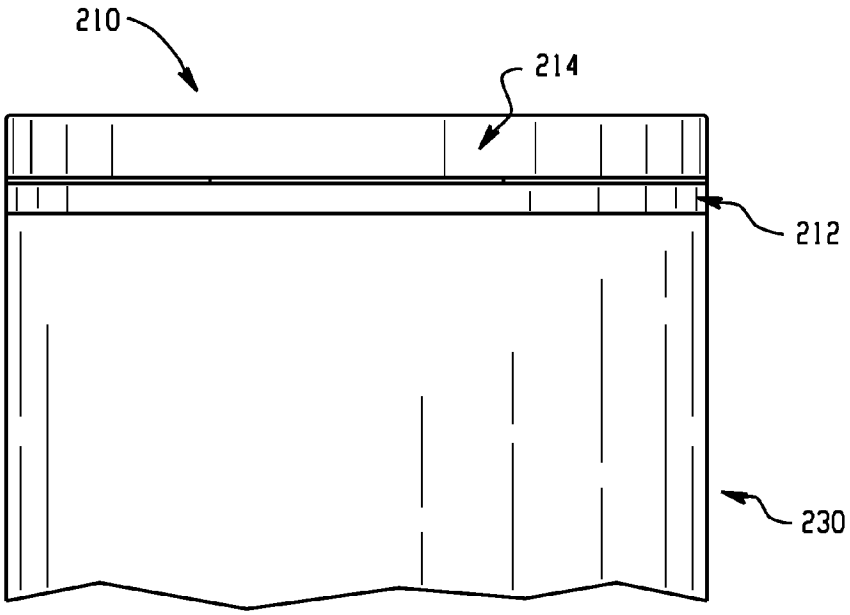
FIG. 19 is another side elevation view of the nest lock platform engaged in the internal collar.
Figure 18:
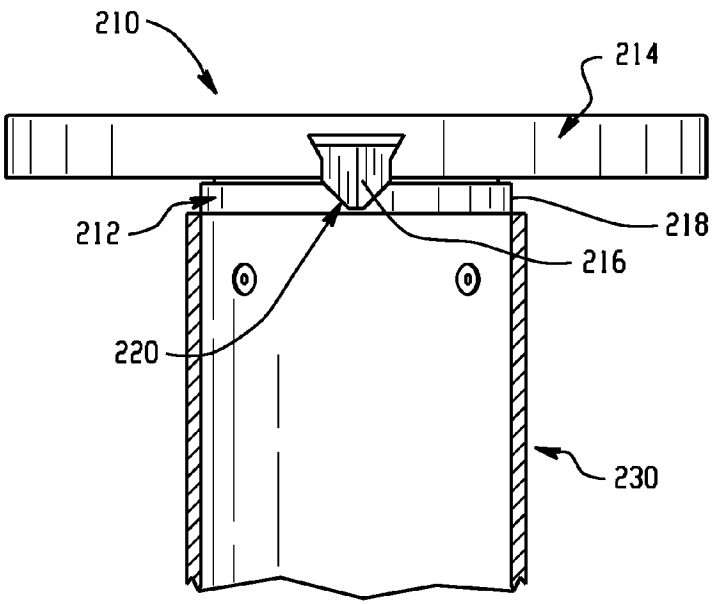
FIG. 18 is a side elevation view of the nest lock platform engaged in an internal collar in accordance with the present disclosure.

With reference to FIGS. 16-19, the nest lock platform assembly 210 acts as a platform for mounting the payload on an upper portion of a base section 230 when the mast assembly is fully retracted. FIGS. 18 and 19 show the nest lock platform assembly 210 engaged in the first internal collar assembly 230.

Figure 20:
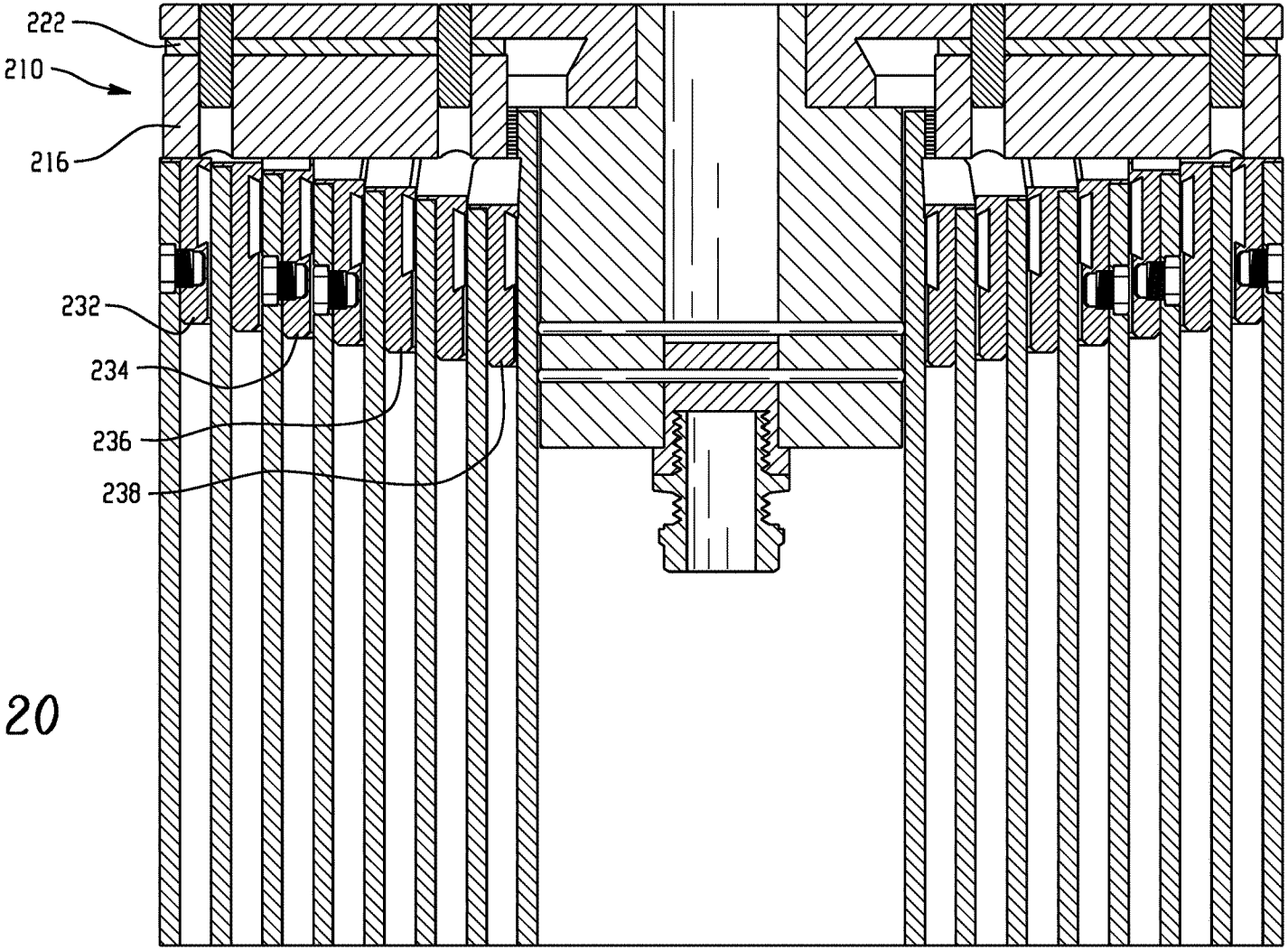
FIG. 20 is a is a cutaway side view of the alternative nest lock system.
Figure 21:
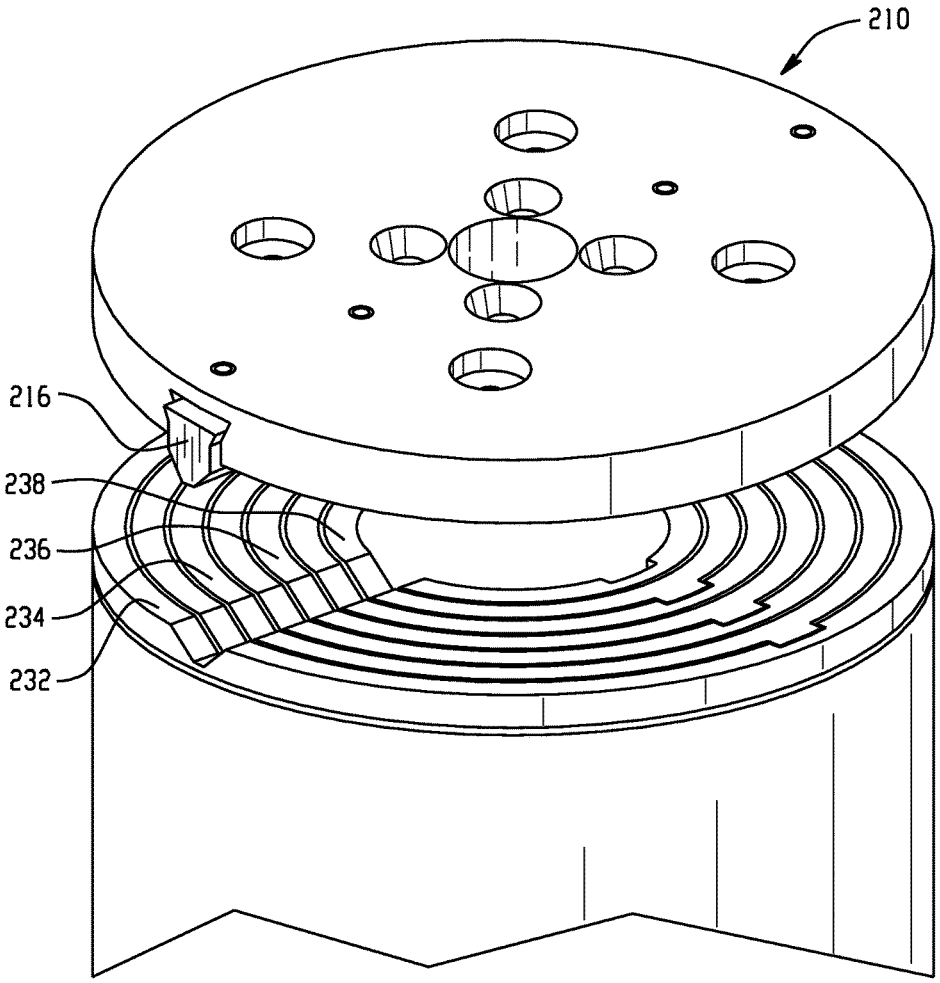
FIG. 21 is a perspective view of the platform and collar lock assembly in a retracted state.

FIGS. 20 and 21 show the mast fully nested. Four internal collars 232, 234, 236, 238 are shown. It is to be understood that any suitable number of internal collars may be incorporated in the mast assembly. When the nest lock platform 210 engages a new internal collar, e.g., 232, the current internal collar, e.g., 234, disengages from the nest lock platform. It is to be understood that the nest lock platform 210 is only engaged to one internal collar assembly at a time, except at the instance in which the nest lock platform is being passed from one collar to the next.

It is noted that the internal collar on the outer most tube is engaged with the nest lock platform assembly. All other tubes are staggered below the outer most collar.

It should now be appreciated that the exemplary mast of the present disclosure typically has a shorter nested height as compared to prior art masts of the same extended length. In addition, both the can style nest lock system and the platform and collar nest lock system may provide both rotational interlocking of the telescoping mast sections as well as protection from the elements.

The exemplary embodiment has been described with reference to the preferred embodiments. Modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A telescoping mast assembly having a mast axis and comprising a plurality of telescoping mast sections having axially opposite ends and being axially slidable relative to one another along the mast axis between retracted and extended positions, the telescoping mast sections including a base tube fixed to a support surface and an innermost telescoping section in the retracted and extended positions, and wherein the innermost telescoping section supports a cylindrical can surrounding at least a portion of an axial end of the base tube in the retracted position of the mast assembly, wherein each telescoping mast section includes an internal collar and a cylindrical body.

2. The telescoping mast assembly of claim 1, wherein the can has a cavity defined by a circular top wall and a cylindrical side wall extending from an edge of the top wall, the cavity having an inner diameter sized to closely receive the axial end of the base tube.

3. The telescoping mast assembly of claim 2, wherein the base tube includes a projection on a circumferentially outer surface thereof, and the side wall of the can includes an opening adapted to receive the projection when the mast assembly is in the retracted position thereby rotationally interlocking the innermost tube section and the base tube.

4. The telescoping mast assembly of claim 3, wherein the protrusion and opening are wedge-shaped.

5. The telescoping mast assembly of claim 4, wherein the protrusion is secured to the base tube with a fastener.

6. The telescoping mast assembly of claim 5, wherein the protrusion is adjacent an axial end of the base tube.

7. The telescoping mast assembly of claim 1, wherein the internal collar includes an annular body adapted to be inserted into an open end of the cylindrical body, the internal collar having a radially outwardly extending shoulder adapted to engage an axial end face of the cylindrical body.

8. The telescoping mast assembly of claim 7, wherein a circumference of the internal collar corresponds to a circumference of the cylindrical body.

9. The telescoping mast assembly of claim 8, wherein the internal collar is secured to the cylindrical body with at least one fastener.

10. The telescoping mast assembly of claim 9, wherein the at least one fastener includes a machine screw.

11. The telescoping mast assembly of claim 1, wherein each telescoping mast section starting with the innermost telescoping mast section has a maximum outer diameter that is smaller than the inner diameter of an axial end opening of the telescoping mast section into which it is received.

12. A telescoping mast assembly having a mast axis and comprising a plurality of telescoping mast sections having axially opposite ends and being axially slidable relative to one another along the mast axis between retracted and extended positions, the telescoping mast sections including a base tube adapted to be fixed to a support surface and an innermost telescoping section, and wherein the innermost telescoping section supports a cylindrical nest lock platform assembly adapted to cover an axial end of the base tube when the mast assembly is in the retracted position, wherein each telescoping mast section includes an internal collar and a cylindrical body and the nest lock platform assembly includes a payload platform and one or more wedges that mate with corresponding notches in the internal collar.

13. The telescoping mast assembly of claim 12, wherein a circumference of the internal collar corresponds to a circumference of the cylindrical body.

14. The telescoping mast assembly of claim 13, wherein the internal collar is secured to the cylindrical body with at least one fastener.

15. The telescoping mast assembly of claim 14, wherein the at least one fastener includes a machine screw.

16. The telescoping mast assembly of claim 15, wherein each telescoping mast section starting with the innermost telescoping mast section has a maximum outer diameter that is smaller than the inner diameter of an axial end opening of the telescoping mast section into which it is received.

* * * * *